US006416600B1

(12) United States Patent
Clarke et al.

(10) Patent No.: US 6,416,600 B1
(45) **Date of Patent: *Jul. 9, 2002**

(54) PROCESS FOR THE PRODUCTION OF AN EXOTHERMICALLY REACTING COMPOSITION

(75) Inventors: Kay Heather Clarke, Cleveland; Derek Alexander Graham, Glasgow; Ray Oliver, Cleveland, all of (GB)

(73) Assignee: Imperial Chemical Industries plc, London (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 08/516,259

(22) Filed: Aug. 17, 1995

(30) Foreign Application Priority Data

Aug. 17, 1994 (GB) ..... 9416582

(51) Int. Cl.[7] ..... C06B 21/00

(52) U.S. Cl. ..... 149/109.6; 149/19.92; 264/3.4

(58) Field of Search ..... 149/19.92, 109.6; 264/3.4

(56) References Cited

U.S. PATENT DOCUMENTS

| | | | | | |
|---|---|---|---|---|---|
| 3,290,788 | A | | 12/1966 | Seelandt | |
| 3,452,445 | A | * | 7/1969 | Higgins | 34/5 |
| 3,685,163 | A | * | 8/1972 | Olt | 34/5 |
| 3,788,095 | A | * | 1/1974 | Murphy et al. | 62/347 |
| 3,819,336 | A | * | 6/1974 | Rogers et al. | 149/76 |
| 3,888,017 | A | * | 6/1975 | McBride | 34/5 |
| 3,892,610 | A | * | 7/1975 | Huzinec | 149/19.92 |
| 3,909,957 | A | | 10/1975 | Passey | |
| 4,177,227 | A | * | 12/1979 | Harvey et al. | 149/19.92 |
| 4,728,376 | A | * | 3/1988 | Kurtz | 149/109.6 |
| 4,981,535 | A | * | 1/1991 | Hadermann et al. | 149/19.92 |
| 5,000,803 | A | * | 3/1991 | Hadermann et al. | 149/19.92 |
| 5,021,395 | A | * | 6/1991 | Druliner et al. | 505/1 |
| 5,098,683 | A | * | 3/1992 | Mehrotra et al. | 423/266 |
| 5,230,162 | A | | 7/1993 | Oyler, Jr. | |
| 5,449,423 | A | * | 9/1995 | Cioffe | 149/19.1 |
| 5,472,647 | A | * | 12/1995 | Blau et al. | 149/109.6 |
| 5,531,845 | A | * | 7/1996 | Flanigan et al. | 149/109.6 |
| 5,665,276 | A | * | 9/1997 | Kirby et al. | 264/3.1 |

FOREIGN PATENT DOCUMENTS

| | | | |
|---|---|---|---|
| EP | 0 554 999 A1 | | 8/1993 |
| GB | 1 228 930 | * | 4/1971 |
| GB | 2 270 686 | | 3/1994 |

OTHER PUBLICATIONS

Research Disclosure Jun., (1992) No. 338, Emsworth, GB, Abstract No. 33834 "Spray Dryed Black Powder" *Drytech p. 450).

* cited by examiner

*Primary Examiner*—Edward A. Miller
(74) *Attorney, Agent, or Firm*—Pillsbury Winthrop LLP

(57) ABSTRACT

A process for the production of an exothermically reacting composition, such as a propellant or explosive, containing at least one normally solid reactive constituent comprises the steps of:

forming a uniform dispersion of the ingredients of the said composition in a carrier liquid;

forming droplets of said dispersion;

feeding said droplets into a cooling medium at a temperature below the freezing point of said carrier liquid to form solidified droplets; and freeze-drying said solidifed droplets.

18 Claims, 5 Drawing Sheets

PROCESS FOR THE PRODUCTION OF AN EXOTHERMICALLY REACTING COMPOSITION

FIELD OF THE INVENTION

This invention relates to a process for the production of an exothermically reactive composition containing one or more finely divided solid constituents, to such compositions produced by the process and to new structures of exothermically reactive compositions.

The invention is particularly useful for the production of explosive or pyrotechnic compositions in the form of microporous particles consisting of agglomerates comprising mixed particles of the constituents of the composition.

Compositions which may advantageously be produced by the process of the invention include, for example, fast-burning gas-generating charges for projectile and rocket propellants, and inflators for vehicle occupant safety restraint 'air-bags', pyrotechnic compositions for example for pyrotechnic delay elements, flares and smoke producers; deflagrating blasting powder; and easily initiated detonating explosives. In exothermically reactive compositions the reactive constituents are preferably in ultrafine form in order to achieve faster reaction rate as a consequence of the large area of the interface between the reacting constituents.

BACKGROUND OF THE INVENTION

Hitherto reactive constituents of exothermically reacting compositions, for example of explosive compositions, have been prepared in fine form by various processes and mixed together. Many of these processes have involved grinding the constituents, singly or together with other ingredients of the composition, dry or wet in a comminution device such as a ball mill. Dry grinding has been described in United Kingdom patent specification no GB 2028785 and U.S. Pat. Nos. 3,895,098, 4,243,443 and 4,376,002. Wet grinding has been described in U.S. Pat. Nos. 3,947,300, 4,999,063 and 5,223,184. A modification of the wet grinding process described in U.S. Pat. Nos. 5,143,567 and 5,223,184 involves wet grinding of ingredients in a slurry and spray drying droplets of the slurry. In these grinding processes crystal sizes less than 5 microns are difficult to produce and, if produced, the fine particles tend to re-unite and form agglomerates, thereby impairing the intimacy of mixing of the ingredients in the reactive composition, since the degree of mixing is commensurate with the largest particle present in the mixture.

An alternative process for the preparation of ammonium perchlorate in the form of small particles described in U.S. Pat. No. 3,788,095 involves spraying a solution of the material into a refrigerated apparatus where it is frozen into small droplets which are subsequently freeze-dried by vacuum sublimation to produce the desired material. The material produced by this process is in the form of agglomerates of fine primary particles. These agglomerates retain their integrity in any subsequent mechanical mixing operation and, accordingly, the intimacy of mixing of the ingredients of a reactive composition containing the material is limited by the size of the agglomerates.

It is an object of this invention to provide a method of making exothermically reacting compositions comprising at least one reactive constituent having a smaller and more uniform crystal size than that of such constituents in compositions hitherto available. A further object is to increase the ease of ignition and burning rate of gas producing compositions for air-bags, projectile and rocket propellants, pyrotechnic compositions, igniters and deflagrating blasting powders and to increase the velocity of detonation and sensitivity to initiation to detonation of blasting explosives.

SUMMARY OF THE INVENTION

In accordance with the invention a process for the production of an exothermically reacting composition containing at least one normally solid reactive constituent comprises:

- forming a uniform dispersion of the ingredients of the said composition in a carrier liquid;
- forming droplets of said dispersion;
- feeding said droplets into a cooling medium at a temperature below the freezing point of said carrier liquid to form solidified droplets; and
- freeze-drying the solidified droplets. In the freeze-drying process the frozen droplets are subjected to pressure and temperature conditions at which vapour from the carrier liquid is removed from the frozen particles by sublimation from the solid phase without any melting of the liquid. The process of the invention produces homogeneous substantially spherical, microporous particles of the exothermically reacting composition consisting of agglomerates comprising uniformly distributed primary particles of the ingredients of the composition containing pores which may be either closed or interconnected, open pores generally having a dimension of 0.2–10 microns. The porosity of the agglomerates is generally 10–80% and preferably 40–70% by volume.

Accordingly the invention also includes an exothermically reacting composition in the form of such microporous particles.

In the agglomerates the particles of solid ingredients which do not dissolve in the carrier liquid substantially retain their original size and integrity, remaining as discrete particles throughout the process, whereas crystals of ingredients which dissolve in the carrier liquid are present as ultrafine crystals. Each agglomerate contains the ingredients of the compositions uniformly distributed in the correct proportions, the degree of mixing being commensurate with the size of the primary particles. The freeze-drying step locks the primary particles in the mixed structure and prevents segregation and re-agglomeration of like particles which occurs in conventional drying processes where the liquid is evaporated from a liquid phase.

The porosity of the microporous particles will be dependent on the concentration of the dispersion and/or the rate of sublimation. Drying of the particles may be accelerated by heating the frozen droplets. Before forming the droplets, any ingredients which are insoluble in the carrier liquid are dispersed in the carrier liquid and the dispersion is maintained in a homogeneous condition by stirring if required. In some cases the dispersion will advantageously contain a thickening agent to obtain a preferred viscosity for droplet formation and to prevent segregation of the ingredients within the droplets. Ideally, however, solid constituents will be dispersed in the carrier liquid as a colloidal suspension of ultrafine particles. Further ingredients may optionally be included in the dispersion to modify the composition.

Preferably the exothermically reacting composition comprises at least one reactive ingredient which is soluble in the carrier liquid, at least a portion of this soluble ingredient being dissolved in the carrier liquid of the dispersion. After freeze-drying this soluble ingredient will be present in the microporous agglomerates in the form of ultrafine particles in uniform admixture with the remaining ingredients. When the soluble ingredient is a crystalline substance the particles will consist of ultrafine crystals.

Water soluble reactive constituents are conveniently dissolved in water but any suitable carrier liquid may be used.

Droplets of the dispersion may be conveniently formed by spraying the dispersion through one or more orifices or by projecting the dispersion from the periphery of a rotating disc or basket in known manner. Preferred droplet diameters are in the range from 50–500 microns, more preferably 75–200 microns if subsequent pressing of the freeze-drying particles is required.

The temperature of the cooling medium may conveniently be in the range −40 to −195° C., and preferably about −80° C. The cooling medium may comprise liquid, for example, liquid air or nitrogen but a gaseous medium is preferred in order to minimise distortion of the droplets and consequently optimise the free running properties of the product particles. Suitable cold gases comprise air, nitrogen, carbon dioxide, argon and helium.

The cold gas is preferably recycled through conventional refrigeration means. Alternatively the cold gas may be cooled by a recycled refrigerated fluid which may, for example, flow through a jacket surrounding a freezing chamber in which the droplets are frozen.

For freeze-drying, the solidified droplets are preferably treated in a vacuum chamber maintained at a pressure below the triple point of the solvent, which for water is 6.11 mbar. Preferably the pressure is maintained at 0.1 to 2.0 mbar. The frozen droplets in the freeze-drying chamber are preferably heated to supply the heat of sublimation of the solvent and increase the vapour pressure, without melting the particles of said reactive constituent. The solvent vapour may conveniently be condensed in contact with a cold surface, leaving the desired freeze-dried solid particles.

The microporous particles produced by this invention comprise uniform agglomerates which are much more reactive than particles of the same composition hitherto available. This has the effect of advantageously increasing the burning rate of pyrotechnic gas-producing compositions such as propellants for firing projectiles or gas-generants for inflating air-bags, increasing the velocity of detonation and ease of initiation to detonation of blasting explosive composition, and enhancing the ignitability and burning rate of deflagrating explosive blasting powders and pyrotechnic compositions. The particles are substantially free of dust, free flowing and collapse readily under pressure to form pressed grains when, for example, pressed grains are required for propellant explosives or gas-producing compositions charges in air-bags. Moreover if some of the carrier liquid, for example water, preferably about 0.5 to 5% by weight and preferably 1 to 2%, remains in the particles, high quality grains can be formed without the inclusion of a pressing agent.

This invention provides a much safer method for producing explosive and pyrotechnic compositions containing finely divided solid reactive constituents than any of the dry mixing processes used hitherto in the manufacture of such explosive compositions since only wet mixing of a dispersion of the ingredients at low temperatures are used, thereby substantially eliminating the risk of overheating by applied heat or friction which could ignite the composition.

Explosive compositions which may advantageously be prepared by the aforedescribed method include those containing alkali metal azides such as sodium azide and oxidizing salts such as nitrates, chlorates and perchlorates of ammonia and the alkali metals.

Thus a sodium azide based gas-generating composition for air-bag inflation may be prepared from a slurry comprising a solution of sodium azide in water containing oxidizing material, such as iron oxide and silicon dioxide, dispersed in the solution. The oxides, which are readily available as ultrafine particles, will remain homogeneously distributed throughout the droplets and the particles produced therefrom. The resulting sodium azide compositions are especially advantageous as they have faster burning rates and the gaseous products contain less sodium and are therefore less toxic.

An air-bag inflation composition based on ammonium nitrate may also advantageously be produced by the aforedescribed process, but in this case, a fuel, which may advantageously be a reactive polymeric binding material, and preferably a water-soluble polymeric material, for example, polyacrylamide will be mixed with a solution of ammonium nitrate and the mixture formed into droplets which are then frozen and freeze-dried. Such a composition is especially advantageous for air-bag inflation as it produces only non-toxic gas with no slag, thus enabling the usual gas filter to be omitted from the air-bag inflator assembly.

The invention also enables the manufacture of a sensitive blasting explosive or blasting agent to be prepared from non-self-explosive ingredients such as mixtures of oxidizing salt and fuel, for example, ammonium nitrate and carbon black. Hitherto such mixtures could only be initiated to detonation by very heavy priming but the product of the present invention can be initiated by a blasting cap, detonating cord or light primer.

The invention may also be advantageously used to manufacture useful deflagrating explosive powder of the black powder class. Black powder is normally made by a process which involves prolonged milling of a composition comprising potassium nitrate, carbon and sulphur but we have found that the same composition produced by the process of the present invention using carbon black instead of charcoal has useful blasting properties although it has slightly lower density than milled black powder. An alternative deflagrating explosive powder may also advantageously be prepared from potassium nitrate and a fuel/binder such as polystyrene sulphonate.

BRIEF DESCRIPTION OF THE DRAWINGS

The production of explosive composition by the process of the invention will be hereinafter described with reference to the accompanying drawings wherein

FIG. 6 is a photomicrograph of the microstructure of the particles produced in Example 3.

DETAILED DESCRIPTION

Figure 1:
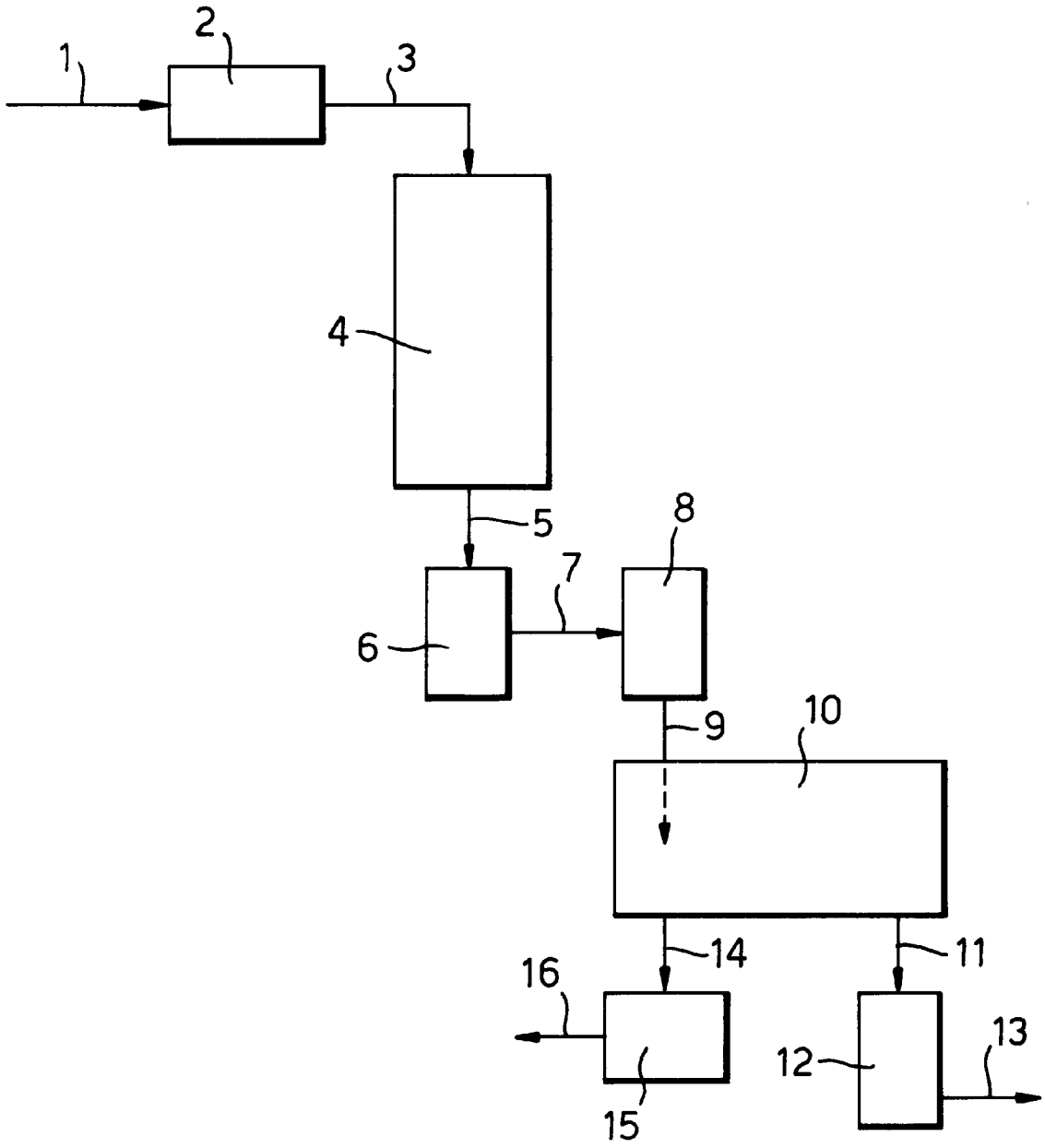
FIG. 1 is a diagrammatic flow-sheet of the process.

Referring to FIG. 1, constituents' of an exothermically reacting composition are mixed in mixer 2 with a carrier liquid to produce a homogeneous or near-homogeneous dispersion 3 in the form of a solution or a suspension having a viscosity between 1 and 1000 cps, preferably 10 to 100 cps, at 20° C.

The well mixed solution or suspension is sprayed as fine droplets into a freezing apparatus 4 containing cold gas. A spherical frozen particulate product 5 is produced in the freezing apparatus 4 and is discharged into a metering hopper 6 where its temperature is regulated, preferably such that the particles warm up but remain below their melting point.

Product stream 7 from hopper 6 is transferred through a vacuum lock 8 from which product stream 9 flows to a vacuum freeze-drying chamber 10 and is distributed as a layer onto a heated surface within the chamber. The heated surface is held at a temperature substantially below the boiling point of the carrier liquid such that the product is not subjected to either eutectic melting or structural collapse phenomena. When the carrier liquid is water a temperature of 20 to 40° C. is preferred. The chamber 10 is held at a pressure below the triple point of the carrier liquid (6.11 mbar in the case of water), preferably in the range 0.1 to 2 mbar. The vapour 14 from the frozen particles 5 is removed by a sublimation mechanism according to the pressure-temperature phase equilibrium for the specific material, yielding a final powder product 11 with up to 5% w/w moisture, preferably in the range 0.01 to 2.5% w/w moisture.

The vapour 14 is conducted to a cold condenser chamber 15 where it condenses and the condensed liquid is removed.

The stream 11 is optionally fed to granulating apparatus 12 where, for example, it may be pressed into grains 13 as required for gas generators or projectile propellants.

Figure 2:
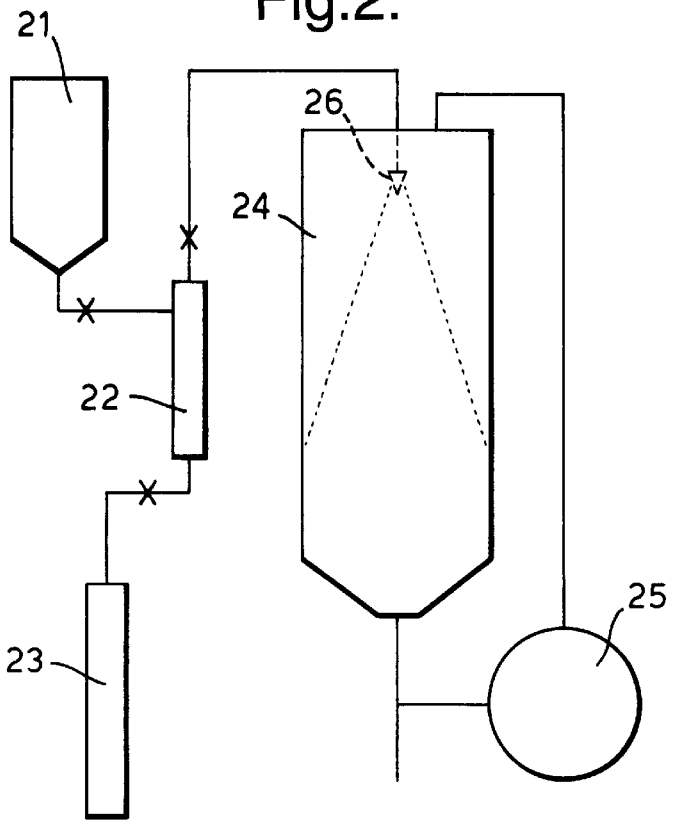
FIG. 2 shows diagrammatically in medial section an apparatus suitable for use in the process of FIG. 1 for freezing droplets.

A freezing apparatus (4 of FIG. 1) suitable for use in the process is shown in FIG. 2. The apparatus comprises a dispersion holding tank 21, a pressure vessel 22, a supply of pressurised gas 23, a refrigerated spray chamber 24 and a cyclone separator 25. The chamber 24 has a spray nozzle 26 connected to the pressure vessel 22. The chambers 21 and 22 may contain stirrers to maintain the homogeneity of the mixed dispersion in the spraying process.

In operation the dispersion of the explosive composition in a carrier liquid is fed from the tank 21 to the pressure vessel 22 from which it is forced under the pressure of the gas 23 through the nozzle 26 to emerge as droplets falling through the chamber 24. Refrigerated gas is circulated through the chamber 24 and the cyclone separator 25. The droplets cool and form solid particles when contacted by the refrigerated gas and are separated in the cyclone separator 26 from which the particles are subsequently transferred to the freeze-drying apparatus.

Figure 3:
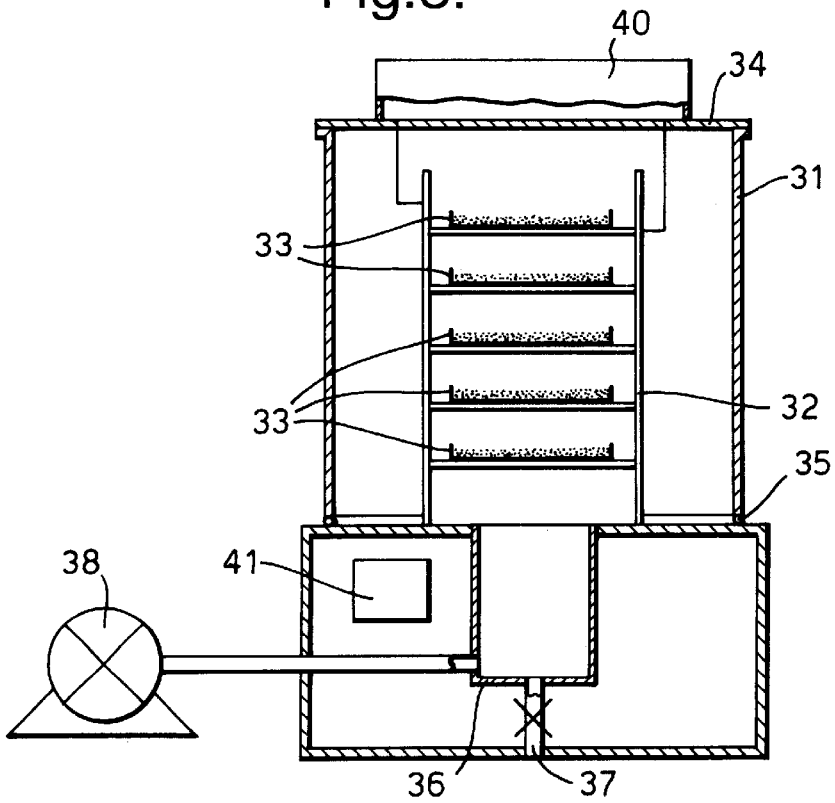
FIG. 3 shows diagrammatically a freeze-drying apparatus suitable for use in the process of FIG. 1.

A batch-freeze drying apparatus (10 of FIG. 1) suitable for use in the process is shown in FIG. 3. The apparatus comprises a drying chamber 31 containing a heated rack 32 on which trays 33 are placed for heating. The chamber 31 has a sealed lid 34 and is connected by a vacuum seal 35 to a cooled condenser chamber 36 provided with a drainpipe 37. A vacuum pump 39 is connected to the chamber 36. A temperature controller 40 is provided to control the temperature of the rack 32 and a pressure gauge 41 is provided to control the pressure in chambers 31 and 36.

In operation, the lid 34 may be removed or the seal 35 may be broken to allow the chambers 31 and 36 to be separated so that the rack 32 and the trays 33 may be put in place. The particles to be dried are loaded on the trays 33, the chambers 31 and 36 are sealed, the pressure in the chambers is reduced to the desired sublimation pressure and the rack is heated to supply the heat of sublimation to the particles. The vapour 14 of the carrier liquid sublimised from the frozen particles condenses in the chamber 36, from which the condensed liquid is removed through the drainpipe 38. At the end of the drying period the pressure in the chambers 31 and 36 is restored to atmospheric the chamber 31 is opened and the dried material is removed.

EXAMPLES

The production of explosive compositions by the process of the invention is further described in the following specific Examples. In the Examples all parts are given by weight.

Example 1

Preparation of Sodium Azide Gas-generant Composition

A dispersion having the following composition was prepared:

| | |
|---|---|
| Sodium azide, $NaN_3$ | 27 parts |
| Iron oxide, $Fe_2O_3$ | 12.4 parts |
| Silicon dioxide, $SiO_2$ | 3.4 parts |
| Water (distilled) | 100 parts |

In the preparation of the dispersion the sodium azide was dissolved in the water and the pH of the solution was adjusted to be within the range 8.5 to 9.5 by the addition of 5N sodium hydroxide solution. Pigment grade iron oxide R1599, as supplied by Harcross having a particle size in the range 0.1–0.2 microns, and fumed silicon dioxide, as sold under the trademark CAB-O-SIL EH5 by The Cabot Manufacturing Co having a particle size in the range 0.05–0.1 microns, were mixed into the sodium azide solution by mixing in a high shear mixer for 20 minutes to form an aqueous dispersion of the composition at room temperature (20° C.)

Figure 4:
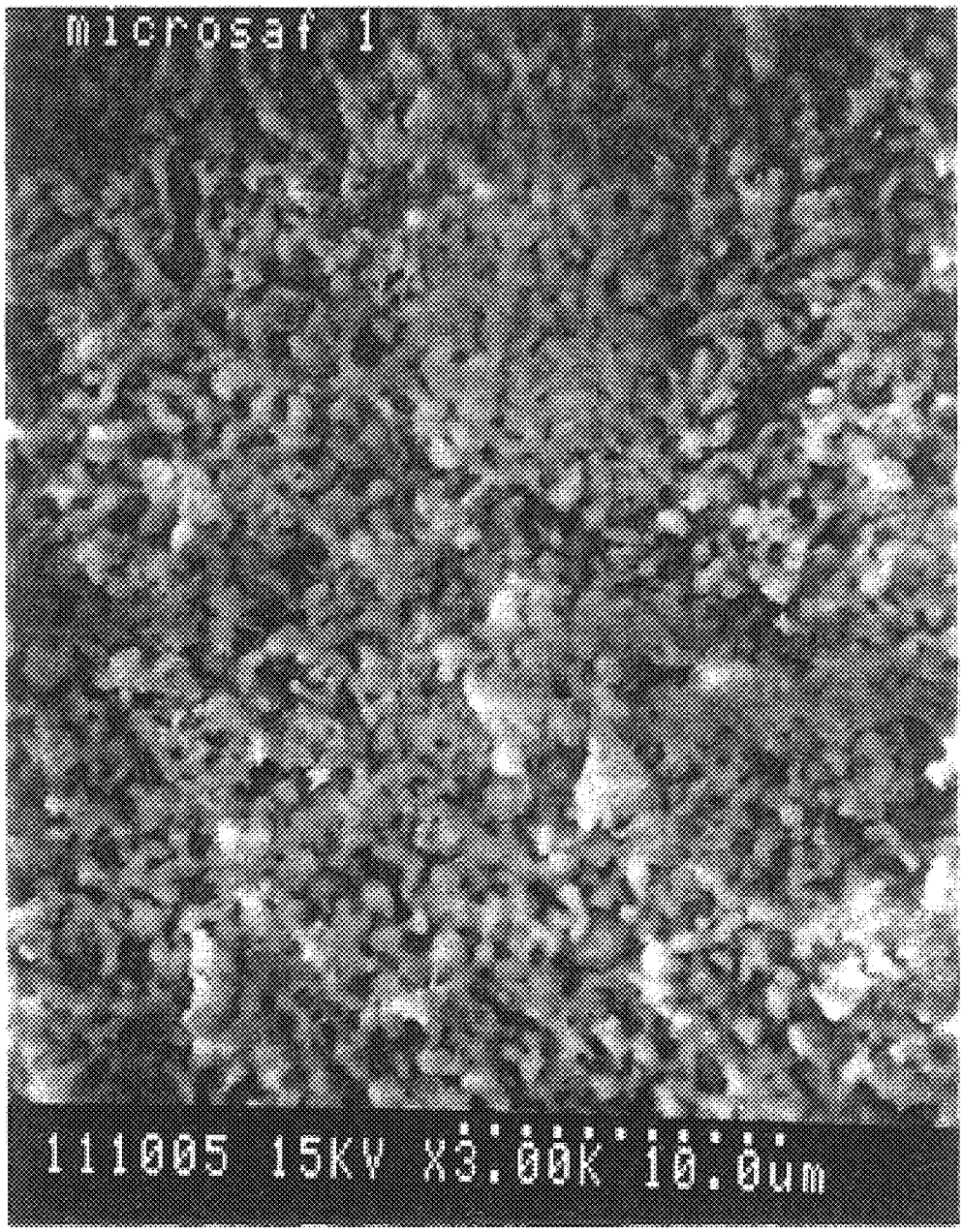
FIG.4 is a photomicrograph of the microstructure of the particles produced in Example 1.

The dispersion was transferred to a pressure vessel and sprayed through a nozzle at a pressure of 5 bar to give 80–250 micron diameter droplets (measured by laser anemometer). The droplet spray was directed into a freezing chamber containing a sufficient volume of cold gas at −80° C. to freeze the droplets. The frozen droplets fell to the bottom of the freezing chamber and were subsequently transferred to a vacuum freeze-dryer. After freeze-drying for 6 hours on a tray heated at 30° C. in a vacuum of 2 millibar to a moisture content of 1.5% the resulting powder consisted of particles which were agglomerates containing sodium azide crystals, iron oxide and silicon dioxide in uniform admixture. The particles were agglomerated into microporous spherical particles, 50–200 microns in diameter, which were very free flowing and could be compressed to a density of 2 g/cc by a pressure of 20,000 psi to form pressed grains with a burning rate of 45 mm/second. The pressed grains, typically in the form of toroidal or flat annular discs, 36 mm outer diameter, 12 mm inner diameter and 5 mm thick, are suitable for use in gas-generant charges for inflating air-bags in vehicle occupant restraint safety systems. A photomicrograph of the microstructure of an agglomerated particle produced in this Example is shown in FIG. 4. This shows a homogeneous substructure of agglomerated crytals of sodium azide, having a maximum dimensions pf 0.2–1 micron, with particles of iron oxide and silicon dioxide uniformly distributed and encapsulated therein. The agglomerated particle contained about 50% by volume of pores, most of which were interconnected, open pores having a maximum dimension of about 0.2–1 micron.

Example 2

Preparation of Ammonium Nitrate Gas Generant Composition

A solution having the following composition was prepared

| | |
|---|---|
| Ammonium nitrate | 50.1 parts |
| Polyacrylamide | 5.17 parts |
| Water | 400 parts |

The solution was prepared by mixing the ingredients until the composition was homogeneous. The solution was then sprayed as droplets into cold gas in which the droplets solidified as spherical particles. The particles were freeze dried as described in Example 1. The resulting powder contained homogeneous, spherical, microporous agglomerates 50–200 microns in diameter containing crystals of ammonium nitrate having a crystal size 0.5–1 micron coated with polyacrylamide. The agglomerates were easily compacted into pressed grains suitable for use in 'air-bag' inflation charges. Pressed charges of the agglomerates were also suitable for use as detonating blasting powders.

Figure 5:
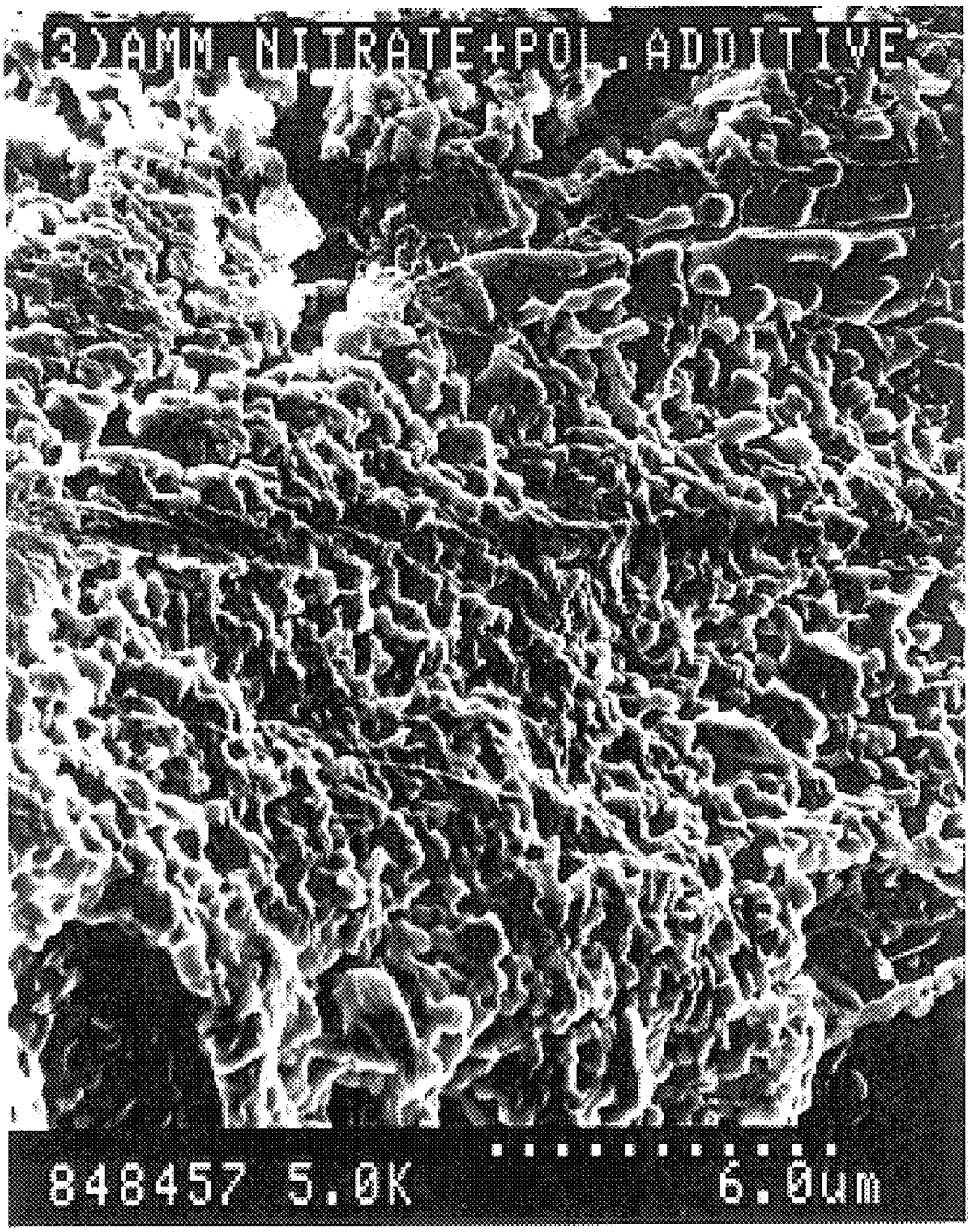
FIG. 5 is a photomicrograph of the microstructure of the particles produced in Example 2.
Figure 5:
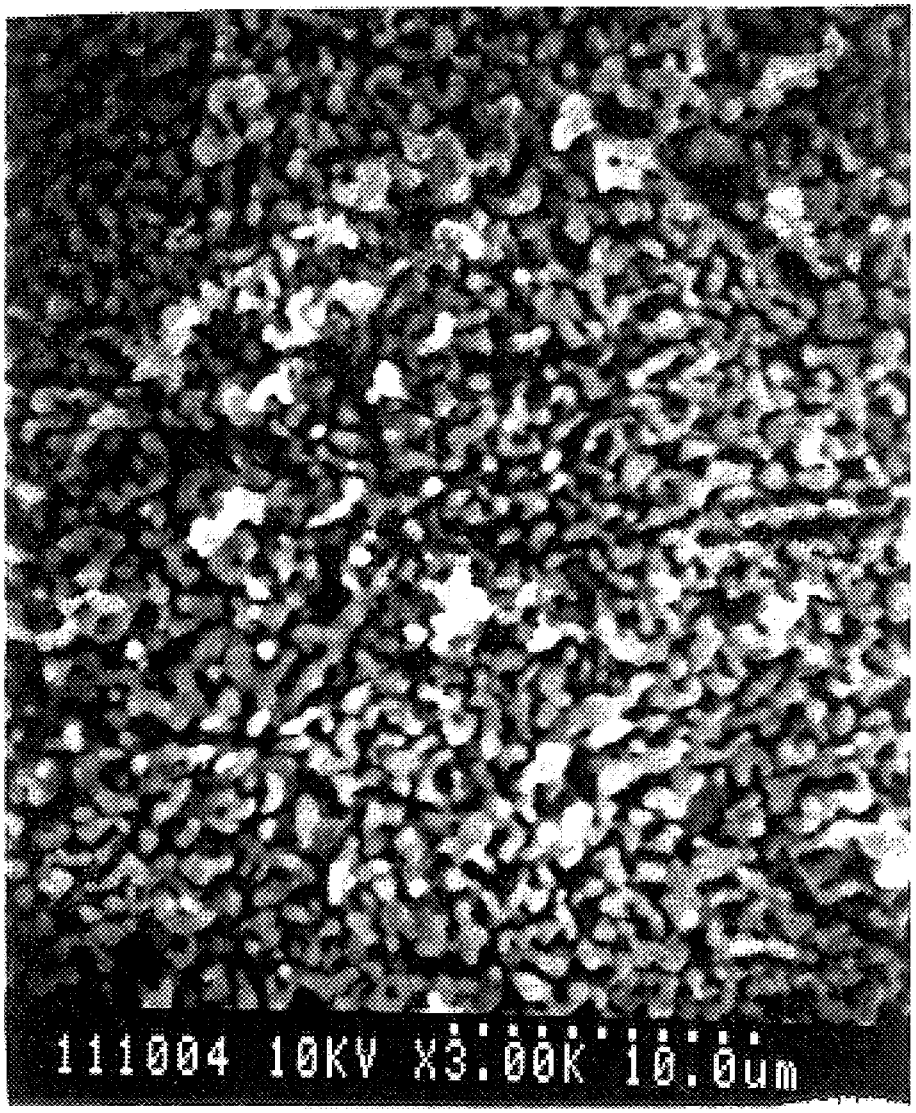

A photomicrograph of the microstructure of an agglomerated particle produced in this Example is shown in FIG. 5. This shows agglomerated particles consisting of very fine crystals of ammonium nitrate about 0.2–1 micron maximum dimension, each surrounded by a thin film of polyacrylamide. The agglomerated particle contained about 50% by volume of pores, most of which were interconnected, open pores having a maximum dimension of 0.2 to 1 micron.

Example 3

Preparation of Ammonium Nitrate Based Blasting Explosive

A dispersion having the following composition was prepared:

| | |
|---|---|
| Ammonium nitrate | 46.7 parts |
| Carbon black (particle size < 0.1 micron) | 3.3 parts |
| Sodium poly(styrene sulphonate)surfactant | 0.1 parts |
| Water | 50.0 parts |

In the preparation of the dispersion the ammonium nitrate was dissolved in the water and the surfactant (crystal growth inhibitor) was mixed into the solution. The carbon black, grade E125 carbon as sold by The Cabot Manufacturing Co was mixed with the solution for 20 minutes in a high shear (Silverson) mixer to produce a slurried dispersion.

The dispersion was formed into droplets which were frozen and freeze-dried by the procedure described in Example 1.

The resulting powder was in the form of free flowing, almost dust free, homogeneous, microporous, spherical agglomerates 50–200 microns average diameter and containing agglomerated crystals of ammonium nitrate encapsulating the carbon black particles.

When packed to a density of 0.95 g/cc in a 30 mm diameter cartridge and initiated to detonation by a blasting cap the velocity of detonation was 4.4 km/second.

A photomicrograph of the microstructure of an agglomerated particle produced in this Example is shown in FIG. 6. This shows a structure wherein the carbon black particles are completely encapsulated in a substructure of agglomerated sub-micron size ammonium nitrate crystals having a maximum dimension of 0.4–2 microns. The agglomerated particle contained about 60% by volume of pores, most of which were interconnected, open pores having a maximum dimension of 0.2–3 microns.

Example 4

Preparation of Deflagrating Explosive

A dispersion having the following composition was prepared:

| | |
|---|---|
| Potassium nitrate | 80 parts |
| Carbon black (as in Example 3) | 10 parts |
| Sulphur (average particle size c. 1.0 micron) | 10 parts |
| Sodium poly(styrene sulphonate) surfactant | 0.1 parts |
| Water | 200 parts |

In the preparation of the dispersion ingredients were mixed for 25 minutes in a high shear mixer to produce a homogeneous dispersion, which was formed into droplets. The droplets were frozen and the product freeze-dried as described in Example 1 to a residual moisture content of 0.1% to produce homogeneous microporous spherical particles in the size range 100–300 microns, which were substantially dust-free and had excellent flow properties. The particles contained agglomerated crystals of potassium nitrate having a maximum dimension of 3–10 microns encapsulating particles of carbon black and sulphur. The agglomerated particles contained about 60% by volume of pores which were mostly interconnected, open pores having a maximum dimension of 1–10 microns. Pressed charges of the agglomerated particles could be easily ignited and had blasting properties similar to black powder.

A 1.2 cm×0.9 cm×2.6 cm test sample of the particles compressed to a density of 1.96 g/cc had a burn rate of 20 mm/second.

Example 5

Preparation of Deflagrating Explosive

A solution having the following composition was prepared:

| | |
|---|---|
| Sodium poly(styrene sulphonate) -(Molecular weight 70,000) | 9 parts |
| Potassium nitrate | 40 parts |
| Water | 100 parts |

In the preparation of the solution the ingredients were stirred and heated at 50° C. until a homogeneous solution was obtained. The solution was formed into droplets which were frozen and freeze-dried by the procedure described in Example 1 to produce spherical dust-free, homogeneous, microporous particles 50–200 microns in diameter which were agglomerates of crystals of potassium nitrate, having a maximum dimension of 0.5–1 micron, coated with sodium poly(styrene sulphonate). The agglomerates contained about 50% by volume of pores, most of which were interconnected, open pores having a maximum dimension of 0.2–1 micron. A 1.2 cm×0.9 cm×2.6 cm test sample of the particle compressed to a density of 1.97 g/cc had a burn rate of 10 mm/second.

Example 6

Preparation of an Igniter Composition

A dispersion having the following composition was prepared by mixing the ingredients for 5 minutes in a high shear mixer:

| | |
|---|---|
| Potassium nitrate | 30 parts |
| Boron (particle size 1–5 microns) | 10 parts |
| Polyacrylic acid (dispersing agent) | 0.5 parts |
| Water | 100 parts |

The dispersion was sprayed through an atomising nozzle into liquid nitrogen to form frozen droplets, 80–250 microns in diameter. The droplets were separated and freeze-dried as described in Example 1 to produce spherical, homogeneous, microporous agglomerates, 50–200 microns in diameter containing agglomerated crystals of potassium nitrate having a maximum dimension of 5–10 microns encapsulating or surrounding the particles of boron. The agglomerates contained about 60% by volume of pores, most of which were interconnected, open pores having a maximum dimension of 1–10 microns.

The product was suitable for use as a pyrotechnic igniter composition.

Example 7

Preparation of a Pyrotechnic Delay Composition

A dispersion having the following composition was prepared by mixing the ingredients in a high shear mixer for 5 minutes.

| | |
|---|---|
| Potassium permanganate | 6 parts |
| Antimony (particles all 10–20 micron) | 5 parts |
| Water | 100 parts |

The dispersion was sprayed through an atomising nozzle into liquid nitrogen to form frozen droplets 80–250 microns in diameter.

The droplets were separated and freeze-dried as described in Example 1 to produce spherical, homogeneous, microporous agglomerates 50–200 microns in diameter containing agglomerated crystals of potassium permanganate having a maximum dimension of 5–10 microns encapsulating or surrounding the particles of antimony. The aggregates contained about 70% by volume of pores, most of which were interconnected open pores of widely varying dimensions. The resulting product was suitable, when pressed, for use as a pyrotechnic charge in an incendiary delay device.

Example 8

Preparation of a Pyrotechnic Delay Composition

A dispersion having the following composition was prepared by mixing the ingredients in a high shear mixer for 5 minutes.

| | |
|---|---|
| Ferric oxide (0.1–0.2 microns) | 30 parts |
| Boron (particles all 1–5 microns) | 13 parts |
| Water | 100 parts |

The dispersion was formed into droplets which were frozen and freeze-dried by the procedure described in Example 1 to produce spherical, homogeneous, microporous, agglomerated particles wherein the ferric oxide and boron particles were intimately mixed. The agglomerates contained about 60% by volume of pores, most of which were interconnected open pores having a maximum dimension of about 10 microns. Compressed charges of the particles were suitable for use as pyrotechnic delay elements.

Example 9

Preparation of a Pyrotechnic Delay Composition

A dispersion was prepared as described in Example 8 except that 0.2 parts of sodium poly(styrene sulphonate) was added as a surfactant to facilitate dispersion of the ingredients.

The product was similar to that of Example 8.

What is claimed is:

1. A process for the production of particles comprising an exothermically reacting composition containing at least one normally solid reactive constituent comprising:

forming a uniform dispersion of ingredients of said composition in a carrier liquid;

forming droplets of said dispersion;

spraying said droplets into a gaseous medium at a temperature below the freezing point of said carrier liquid to form solidified droplets in said gaseous medium; and freeze-drying said solidified droplets.

2. A process as claimed in claim 1 wherein the exothermically reactive composition comprises at least one reactive ingredient which is soluble in the carrier liquid and is at least partially dissolved in the carrier liquid.

3. A process as claimed in claim 1 wherein the said reactive constituent is water-soluble and the said carrier liquid comprises water.

4. A process as claimed in claim 1 wherein the dispersion is formed into droplets having diameter in the range from 50–500 microns.

5. A process as claimed in claim 1 wherein the temperature of the cooling medium is in the range −40 to −195° C.

6. A process as claimed in claim 1 wherein the said solidified droplets are freeze-dried by heating in a vacuum chamber at a pressure below the triple point of the solvent, and condensing the sublimed solvent vapour on a cold surface.

7. A process as claimed in claim 4 wherein the droplets have a diameter in the range of 75 to 200 microns.

8. A process as claimed in claim 6 wherein the pressure is below 6.11 mbar.

9. A process as claimed in claim 8 wherein the pressure is maintained at 0.1 to 2.0 mbar.

10. A process as claimed in claim 6 wherein the solvent is water.

11. A process as claimed in claim 1 wherein the gaseous cooling medium is selected from the group consisting of air, nitrogen, carbon dioxide, argon and helium.

12. The process as claimed in claim 1 wherein the gaseous medium is recycled through a refrigeration means.

13. The process as claimed in claim 1 wherein the gaseous medium is cooled by a recycled refrigerated fluid.

14. The process as claimed in claim 1 wherein the particles have a pore size of from 0.2 to 10 microns.

15. The process as claimed in claim 1 wherein the particles have a pore size of from 0.2 to 1 micron.

16. The process as claimed in claim 1 wherein the particles have a porosity of from 10% to 80% by volume.

17. The process as claimed in claim 1 wherein the particles have a porosity of from 40% to 70% by volume.

18. The process as claimed in claim 1 wherein the reactive constituent is a mixture which includes sodium azide and iron oxide; ammonium nitrate and a fuel; ammonium nitrate and carbon black; potassium nitrate, carbon and sulfur; potassium nitrate and sodium poly(styrene sulfonate); potassium permanganate and antimony; ferric oxide and boron; and/or potassium nitrate and boron.

* * * * *